US006786441B2

(12) United States Patent
Osterloh et al.

(10) Patent No.: US 6,786,441 B2
(45) **Date of Patent: *Sep. 7, 2004**

(54) BOBBIN CREEL FOR TEXTILE MACHINES AND ACTUATING VALVE FOR ADJUSTING SUCH A BOBBIN CREEL

(75) Inventors: Markus Osterloh, Kempten (DE); Ingo Filz, Viersen (DE)

(73) Assignee: Volkmann GmbH, Krefeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/249,626

(22) Filed: Apr. 25, 2003

(65) Prior Publication Data

US 2003/0201354 A1 Oct. 30, 2003

(30) Foreign Application Priority Data

Apr. 26, 2002 (DE) ..... 102 18 590

(51) Int. Cl.[7] ..... D03J 5/08; B65H 49/00; B65H 67/00; F15B 13/04

(52) U.S. Cl. ..... 242/131; 242/129; 242/591; 242/474; 242/559.1; 91/420; 91/465

(58) Field of Search ..... 242/131, 131.1, 242/129, 591, 474, 560, 559.1; 91/420, 465

(56) References Cited

U.S. PATENT DOCUMENTS 4,162,025 A * 7/1979 Achelpohl et al. ..... 221/72
4,163,357 A * 8/1979 Greive et al. ..... 57/58.36
4,175,717 A * 11/1979 Mathiolon et al. ..... 242/131
4,493,244 A * 1/1985 Stillfried et al. ..... 91/420
4,614,148 A * 9/1986 Bates ..... 91/420
4,730,466 A * 3/1988 Tenconi ..... 66/125 R
6,003,428 A * 12/1999 Mundie et al. ..... 91/459
6,059,221 A * 5/2000 Broger et al. ..... 242/559.1
6,065,288 A * 5/2000 Glomeau ..... 60/476

FOREIGN PATENT DOCUMENTS

FR 2794136 * 5/1999

* cited by examiner

*Primary Examiner*—Kathy Matecki
*Assistant Examiner*—Evan H Langdon
(74) *Attorney, Agent, or Firm*—Gudrun E. Huckett

(57) ABSTRACT

A bobbin creel is supported on a holder so as to be pivotable by a four-bar linkage arranged on the machine frame of a textile machine. The holder forms the stationary member of the four-bar linkage. The bobbin creel is pivotable from a lower loading position into an upper operating position by a pneumatic cylinder connected with one end on the holder and with the other end to one of the movable four-bar linkage members. For pivoting the bobbin creel from the upper operating position into the lower loading position, the pneumatic cylinder is a bidirectional pneumatic cylinder loadable at both ends with compressed air and a correlated actuating valve.

18 Claims, 11 Drawing Sheets

BOBBIN CREEL FOR TEXTILE MACHINES AND ACTUATING VALVE FOR ADJUSTING SUCH A BOBBIN CREEL

BACKGROUND OF INVENTION

The invention relates to a bobbin creel which is supported on a holder so as to be pivotable by means of a four-bar linkage arranged on the machine frame of a textile machine, wherein the holder forms the stationary member of the four-bar linkage, and which is pivotable from a lower loading position into an upper operating position by means of a pneumatic cylinder connected with one end to the holder and with the other end to one of the movable four-bar linkage members.

The four-bar linkage, by definition, is comprised of four members connected to one another by four joints of which one member is stationarily mounted while the other three members, as a function of the selected dimensions of the individual members, are capable of carrying out the required rotary or swinging motions.

In a bobbin creel disclosed in FR 2 794 136 A1, a pneumatic cylinder is provided which is loaded at one end by compressed air. In order to assist the upward pivoting of the bobbin creel, provided with at least one feed, into the upper operating position, the pneumatic cylinder is loaded or supplied with compressed air such that the piston rod is moved out of the cylinder. Moreover, a spring is provided which is connected with one end to the holder and with the other end to that member of the four-bar linkage positioned opposite this holder, which spring is apparently provided in order to assist the work of the pneumatic cylinder during the upward pivoting action, on the one hand, and to secure the bobbin creel in the upper operating position, on the other hand. The downward pivoting of the bobbin creel into the lower loading position is realized exclusively by hand, in particular, against the force of the last mentioned securing spring as well as against the force of the compressed air cushion that is present in the cylinder chamber loadable with compressed air; the compressed air cushion is relieved during the downward movement by a venting bore.

SUMMARY OF INVENTION

The invention has the object to improve a bobbin creel in such a way that the manual operation is simplified or facilitated even during the downward pivoting action of the bobbin creel.

As a solution to this object, the pneumatic cylinder is a pneumatic cylinder which can be loaded from both ends with compressed air and comprises two pressure chambers which are separated from one another by the piston of the pneumatic cylinder such that, for pivoting the bobbin creel into the lower position, the pneumatic cylinder can be loaded with compressed air for retracting the piston rod or the piston into the cylinder chamber.

While in the known bobbin creel a first end of the pneumatic cylinder engages a member of the four-bar linkage that is directly connected to the holder, i.e., the stationary member of the four-bar linkage, and particularly engages a lifter mounted on this pivotable member, according to a further embodiment of the invention it is provided that the pneumatic cylinder with its first end is pivotably connected to the four-bar linkage member opposite the stationary holder so that the space needed for the entire system is reduced.

According to a further embodiment of the invention, a pneumatic spring is pivotably connected with both ends to the four-bar linkage and, when pivoting the bobbin creel into the loading position, is tensioned; the energy stored in this way is released for assisting the pneumatic cylinder, on the one hand, and for assisting manual actuation, on the other hand, when pivoting the bobbin creel upwardly.

As a function of the weight of the bobbin creel loaded with one or several feed bobbins, one pneumatic cylinder or two parallel positioned pneumatic cylinders can be provided according to the invention. In the case of two pneumatic cylinders, the pneumatic spring is preferably arranged centrally between the pneumatic cylinders.

Such a system provided with two pneumatic cylinders is particularly advantageous when the bobbin creel according to the invention has several adjacently positioned receiving members for placing feed bobbins thereon such that this bobbin creel is mounted substantially centrally between two work locations to which the threads or yarns removed from the feed bobbins are to be supplied.

According to a further embodiment of the invention, the bobbin creel according to the invention is preferably controlled by means of an actuating valve wherein the valve system comprises two 3/2 port directional control valves arranged immediately upstream of the pneumatic cylinder as well as two check valves which are positioned individually in branch lines connecting one of the relay valves with one of the two 3/2 port directional control valves, wherein a control line extending to the other one of the two 3/2 port directional control valves is connected to the branch line, respectively, wherein by means of the control line the two 3/2 port directional control valves can be moved between their compressed air through positions and their pressure relief positions such that a) for relay valves that are not actuated the 3/2 port directional control valves are in their compressed air through positions while the relay valves are in a position venting the branch lines, while b) upon actuation of one of the two relay valves, respectively, it assumes a compressed air through position relative to the branch line connected thereto.

DETAILED DESCRIPTION

Figure 1:
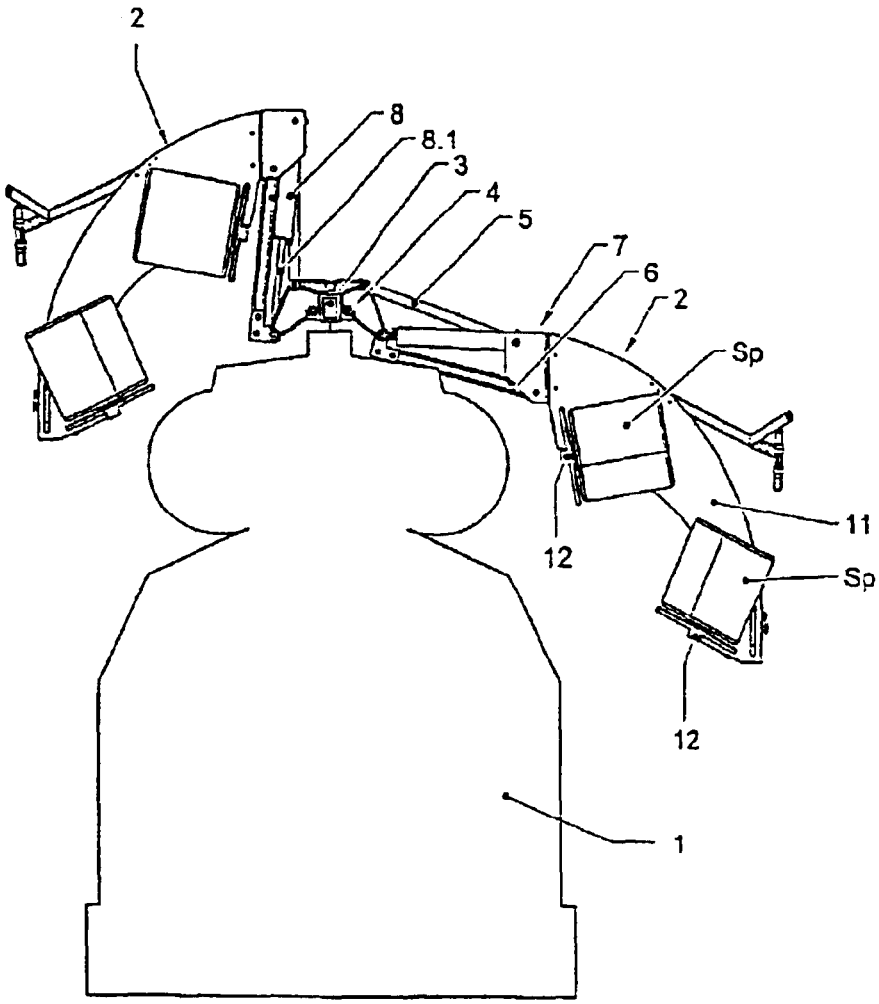
FIG. 1 shows in a schematic illustration a side view of a textile machine, for example, a twisting machine, provided in the longitudinal direction of the machine on both sides with work locations and having bobbin creels arranged pivotably on its topside so as to supply the opposed machine sides.

The textile machine 1 only schematically illustrated in FIG. 1 is, for example, a twisting machine provided in the longitudinal direction on both sides with twisting spindles. According to FIG. 1, the bobbin creel 2 correlated with the left machine side is shown in its upper operating position. The bobbin creel 2 correlated with the right side of the machine is illustrated in its lower loading or supplying position. According to FIG. 2, each bobbin creel 2 is configured as a twin bobbin creel and provided or loaded with four feed bobbins Sp so that two neighboring twisting spindles can be served by a single bobbin creel, respectively. The feed bobbins Sp are so-called single feed bobbins for the outer thread of the twisting process.

According to FIG. 1, each bobbin creel 2 is fastened by means of a holder 4 on the topside of the twisting machine 1 on a support 3 extending in the longitudinal direction of the machine. On this holder 4, which forms the stationary part of a four-bar linkage, two further opposed members 5 and 6 are pivotably connected, wherein at their ends, opposite the holder 4, the fourth member 7 of the four-bar linkage is pivotably connected.

For reasons of stability, the holder 4 forming the stationary member of the four-bar linkage is comprised of two frame parts 4.1 positioned at a spacing to one another. Between them, an upper axle 4.2 and a lower axle 4.3 are supported. The four-bar linkage member 7 is box-shaped with two opposed sidewalls 7.1 which are connected to one another by an end wall 7.4 and between which an upper axle 7.2 and a lower axle 7.3, illustrated in dashed lines, are supported.

On the two upper axles 4.2 and 7.2, the four-bar linkage member 5 is pivotably supported. The four-bar linkage member 6 that is supported on the lower axles 4.3 and 7.3 has the shape of a box profile for reasons of stability.

Figure 2:
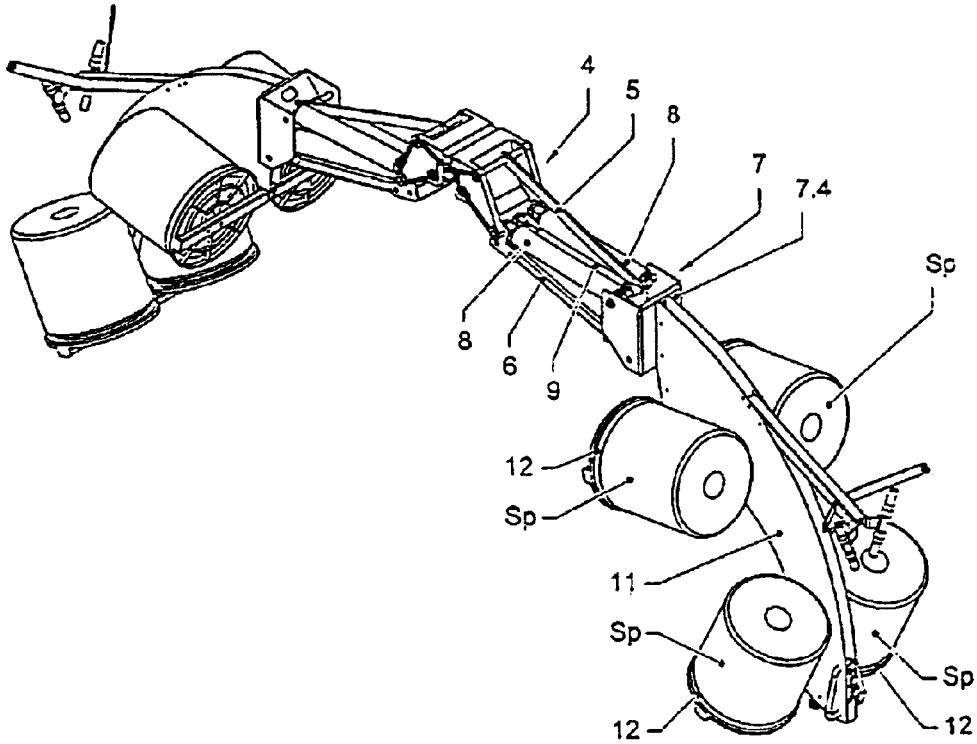
FIG. 2 shows a view of two bobbin creels positioned opposite one another in their lower loading position according to a first embodiment of the invention.
Figure 3:
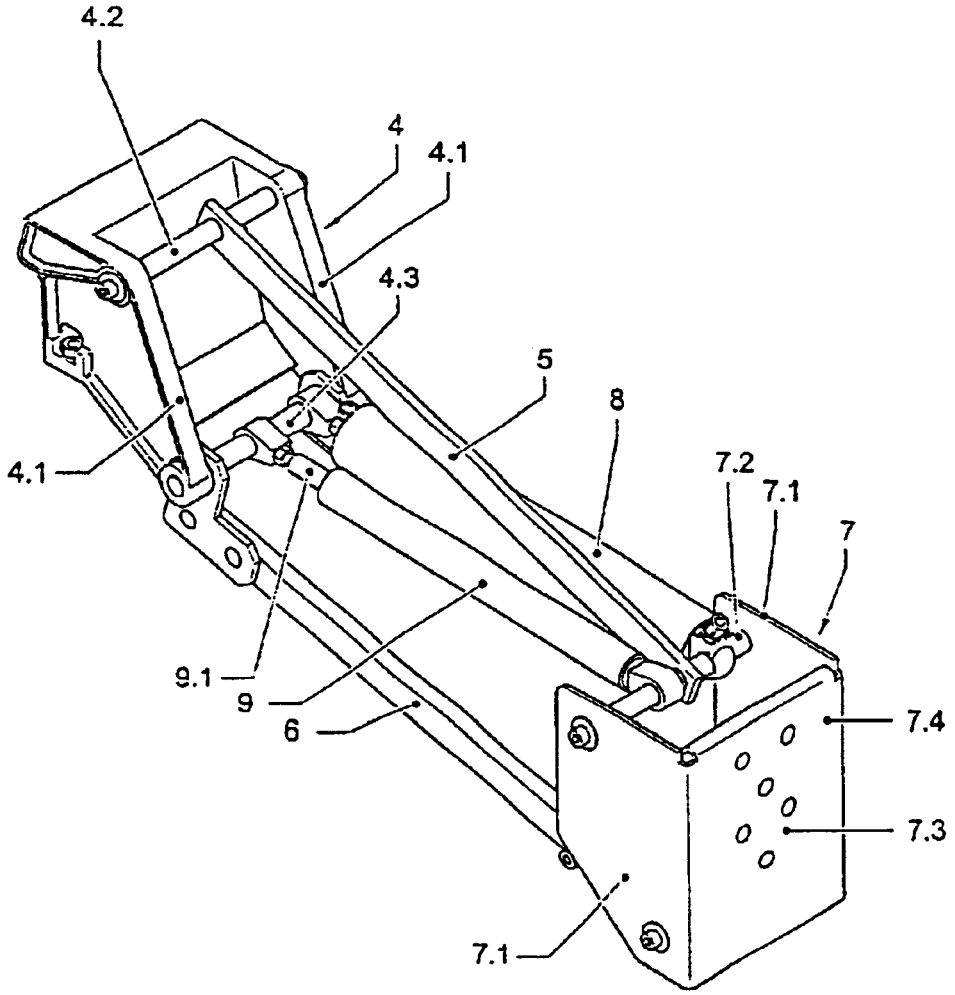
FIG. 3 shows a modified embodiment relative to FIG. 2.

In the embodiment according to FIG. 2, two adjacently positioned pneumatic cylinders 8 as well as a pneumatic spring 9 arranged between these two pneumatic cylinders 8 are supported so as to be pivotable on the axles 4.3 and 7.2 (see FIG. 3). The pneumatic spring 9 is comprised, by definition, of a cylinder into which a piston rod 9.1, optionally with a piston connected thereto, can be moved for pretensioning the gas volume contained in the closed cylinder chamber.

According to FIG. 3, only one pneumatic cylinder 8 is pivotably supported on the axles 4.3 and 7.2 adjacent to the pneumatic spring 9.

Each pneumatic cylinder 8 is a so-called bidirectional pneumatic cylinder loaded at both ends with compressed air; it contains two compressed air chambers which are separated from one another by a piston and can be supplied alternatingly with compressed air.

According to FIG. 2, a frame 11 is attached to the end wall 7.4 forming a securing plate; the frame supports on both sides two receiving members 12 for feed bobbins Sp.

On the front side of each center stay 11, an actuating valve is provided which is connected by compressed air lines (not illustrated), on the one hand, to a compressed air source and, on the other hand, to the two compressed air chambers of the pneumatic cylinder 8.

For the purpose of pivoting the bobbin creel downwardly into the lower position illustrated in FIG. 1 for loading the bobbin creel 2 with new feed bobbins Sp, the compressed air cylinder 8 is loaded with compressed air such that its piston rod 8.1 (see FIG. 1) with the piston attached thereto is retracted into the cylinder chamber. At the same time, the pneumatic spring 9 is pretensioned by retraction of the piston rod 9.1.

After completion of the loading or supply process, the piston rod 8.1 is again moved out of the cylinder by means of a corresponding valve actuation so that the bobbin creel 2, assisted by the pneumatic spring 9, is pivoted into its upper position.

Figure 5:
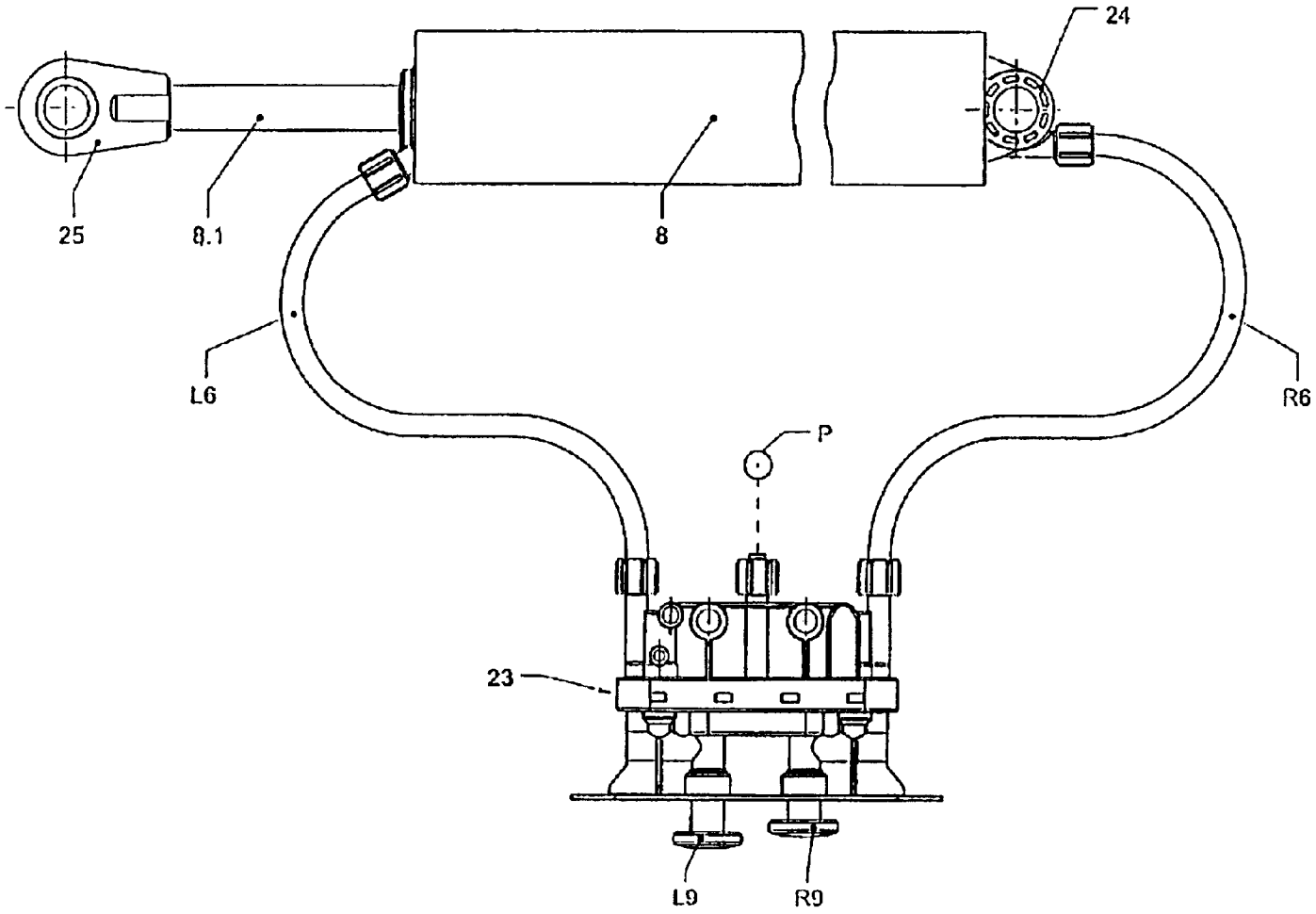
FIG. 5 shows a side view of the actuating valve connected to a bidirectional pneumatic cylinder.

FIG. 5 shows a bidirectionally acting pneumatic cylinder 8 with compressed air lines L6, R6, connected to an actuating valve 23, opening on the opposite ends. A piston (not illustrated) mounted on the piston rod 8.1 can be loaded with compressed air by means of the compressed air connecting line L6 or R6 while the opposed cylinder chamber or pressure chamber can be vented via the other line R6 or L6. On the pneumatic cylinder 8 a drag bearing 24 is provided. A further drag bearing 25 is mounted on the piston rod 8.1 in order to connect the pneumatic cylinder to two machine parts which are movable relative to one another.

Figure 4A:
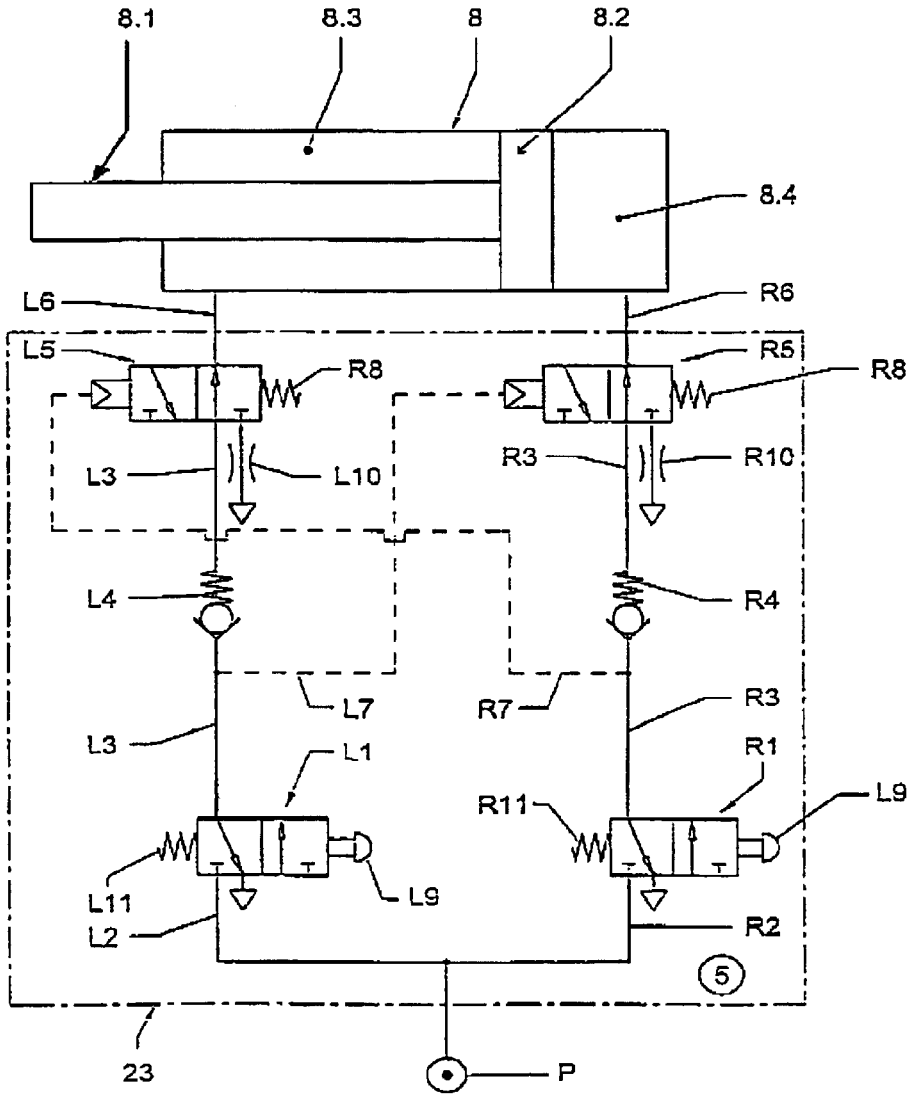
FIG. 4*a* shows a basic connection diagram of an actuating valve for a pneumatic cylinder configured to actuate a bobbin creel in the rest position.
Figure 4B:
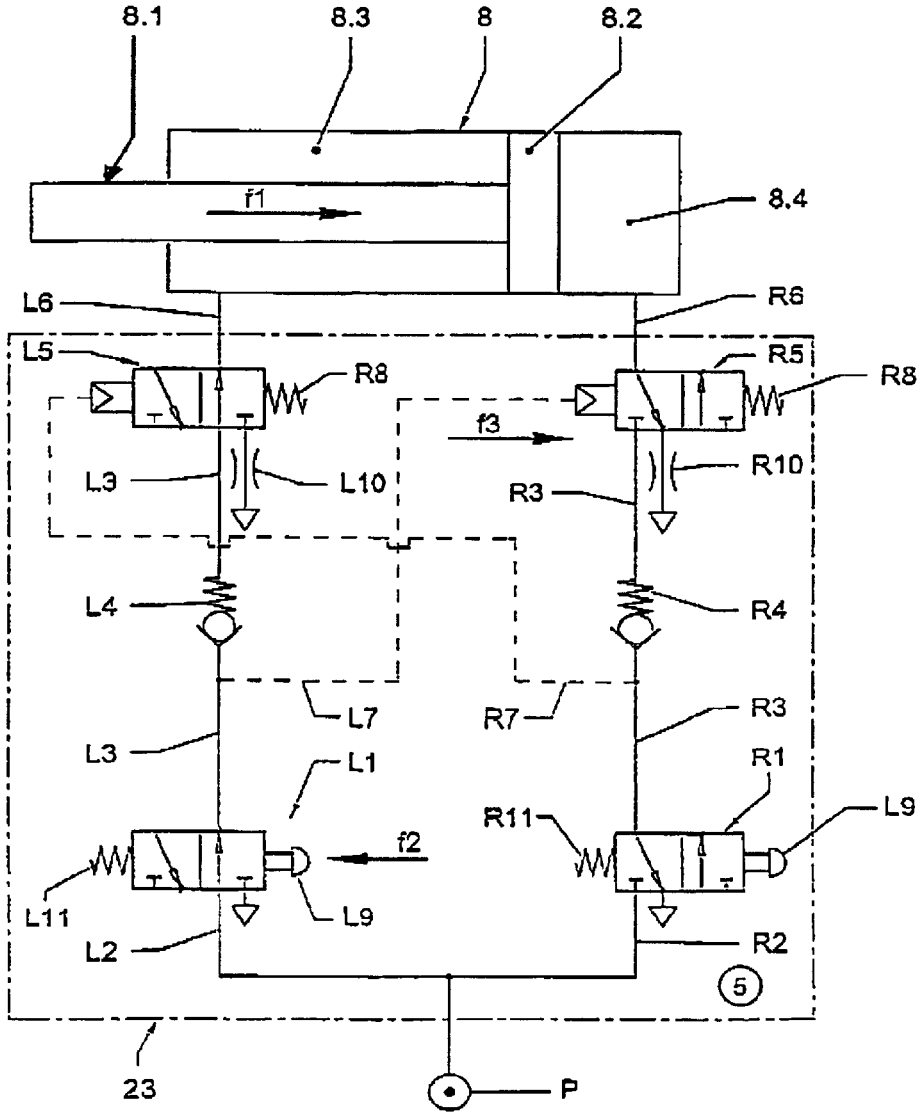
FIG. 4*b* shows the connection diagram in one of the two operating positions.

FIG. 4*a* shows the actuating valve 23 in the rest position; FIG. 4*b* shows an operating position in which the piston rod 8.1 is being retracted in the direction of arrow f1 into the cylinder 8.

According to FIG. 4*a*, two relay valves in the form of, for example, manually actuated 3/2 port directional control valves L1, R1, are connected by means of connecting lines L2, R2 to a compressed air source P. Branch lines L3, R3 are connected to the relay valves L1, R1; they contain check valves L4, R4 and extend to two 3/2 port directional control valves L5, R5 which, by means of lines L6, R6, are connected or connectable to the pressure chambers 8.3, 8.4 of the pneumatic cylinder 8. A control line L7 branches off the branch line L3 between the relay valve L1 and the check valve L4 and extends or is connected to the 3/2 port directional control valve R5 in order to adjust, when loading this control line L7 with compressed air, the 3/2 port directional control valve R5 against the force of the spring R8 into the venting position. A control line R7 serves the same purpose for adjusting the 3/2 port directional control valve L5 against the force of the return spring R8. The relay valves L1, R1 as well as the check valves L4, R4 and the valves L5, R5 are preferably seat valves which have valve bodies provided with sealing rings which can be moved against a spring force into the valve chambers provided with corresponding valve seats for the sealing rings.

When actuating the relay valve L1 by means of the actuating element or key button L9 in the direction of arrow f2, the connection between the line L2 and the branch line L3 is realized so that the check valve L4 is opened and the compressed air can flow via the line L6 into the pressure chamber 8.3. At the same time, via the control line L7 branching off the branch line L3, the 3/2 port directional control valve R5 is adjusted in the direction of arrow f3 into the venting position in which the pressure chamber 8.4 is vented via the line R6 and a venting throttle R10.

Release of the key button L9 causes the relay valve L1 to be returned by the restoring spring L11 into the rest and venting position illustrated in FIG. 4*a* so that the control line L7 is vented and thus the 3/2 port directional control valve R5 is again returned under the effect of the restoring spring R8 into its initial position.

The actuating valve according to the invention thus combines, when viewed schematically, four separate 3/2 port directional control valves as well as two check valves which are preferably embodied as seat valves and are connected with one another such that, for example, in the case of manual actuation of one of the two relay valves L1, R1, compressed air can flow into one of the two pressure chambers of the pneumatic cylinder while the other pressure chamber is vented in a defined way by means of a venting throttle so that, upon release of the previously actuated relay valve, the pneumatic cylinder remains loaded on both ends with compressed air and, in this way, a positional locking of the pneumatic cylinder or of its piston is realized.

Upon actuation of the relay valve R1 by means of the key button L9, the pressure chamber 8.4 is loaded with compressed air while the pressure chamber 8.3 is vented via the throttle L10 correlated with the 3/2 port directional control valve L5.

The actuating valve 23 illustrated in a preferred configurational embodiment in FIGS. 6, 7, 8, 9*a* and 9*b* is characterized in that the valve or control elements, described in connection with FIGS. 4*a* and 4*b*, are mounted in a space-saving way in a compact valve module.

Figure 6:
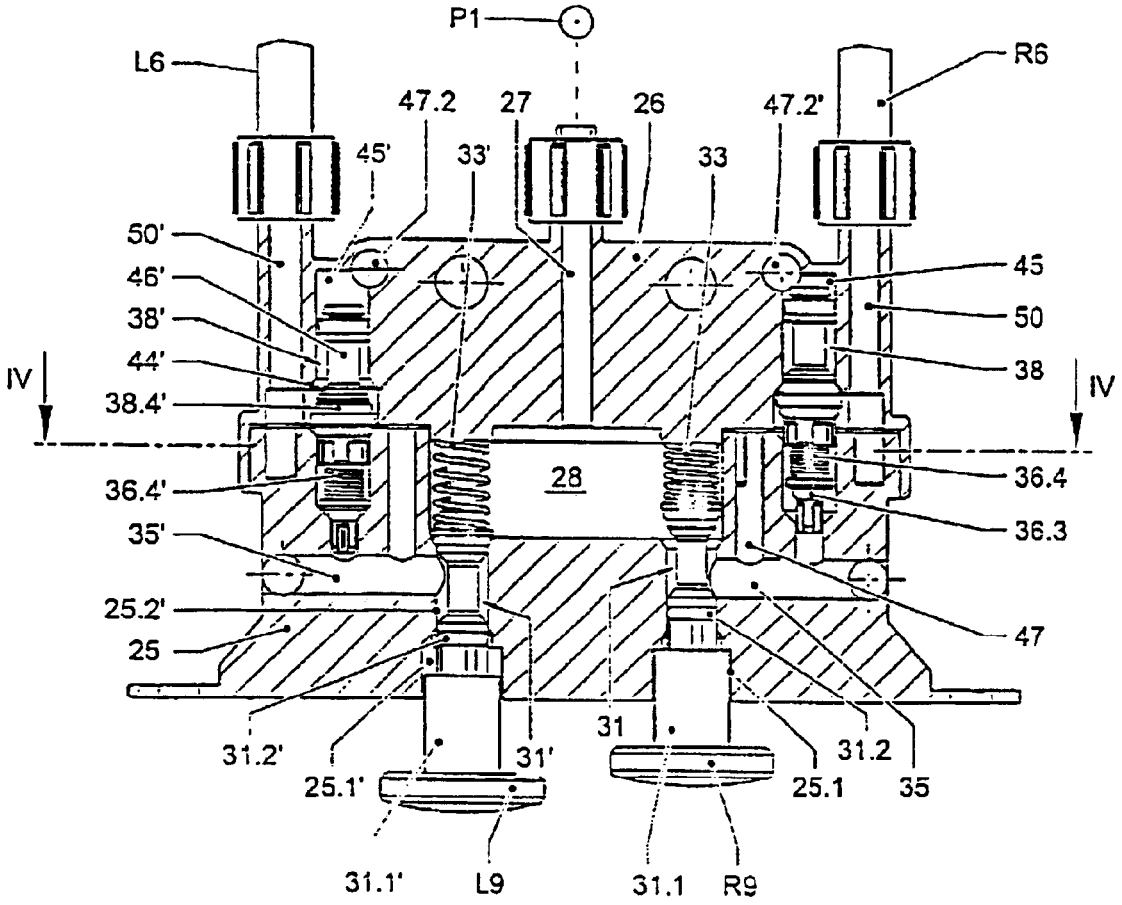
FIG. 6 shows a sectional view of the actuating valve.

According to FIG. 6, this valve module is comprised of a bottom part 25 as well as a top part 26. A channel 27 guided through the top part 26 and connectable to a compressed air source P opens into a distribution chamber 28. In the bottom part 25 two valve bodies 31, 31' are supported or guided which can be moved by means of the key buttons L9, R9 against the force of the restoring springs 33, 33' into the distribution chamber 28.

The valve body 31 is supported by means of a valve shaft 31.1 with formation of an annular gap in a bore 25.1 of the valve module bottom part 25 such that the section of the bore 25.1 positioned above the valve shaft 31.1 is open toward the surroundings, as illustrated in FIG. 6 for the key button L9; see drive shaft 31.1' and bore 25.1'.

A bore section 25.4 and a valve chamber 25.2 adjoin the bore 25.1; a sealing ring 31.2 of the valve body 31 supported on both sides is sealingly guided in the valve chamber upon actuation of the key button R9. The diameter of the bore section 25.4 is greater than the diameter of the valve chamber 25.2 such that the sealing ring, when the relay valve is not actuated, is arranged such in the bore section 25.4 that laterally past this sealing ring 31.2 a connection between the channel 35 and the surroundings is established. The valve chamber 25.2 opens, while forming a valve seat 25.3, into the distribution chamber 28. A channel 35 adjoins laterally the valve chamber 25.2 above the sealing ring 31.2.

A sealing ring 31.4 of the valve body 31 is pressed in the rest position by the spring 33 against the valve seat 25.3, as illustrated in FIG. 6 for the valve body 31'.

Figure 7:
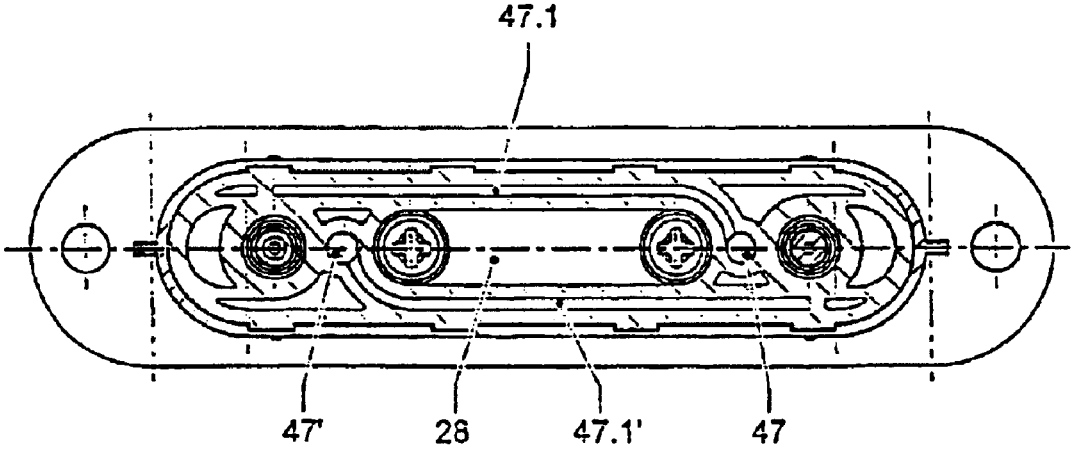
FIG. 7 shows a sectional view according to the arrows IV—IV of FIG. 6.
Figure 8:
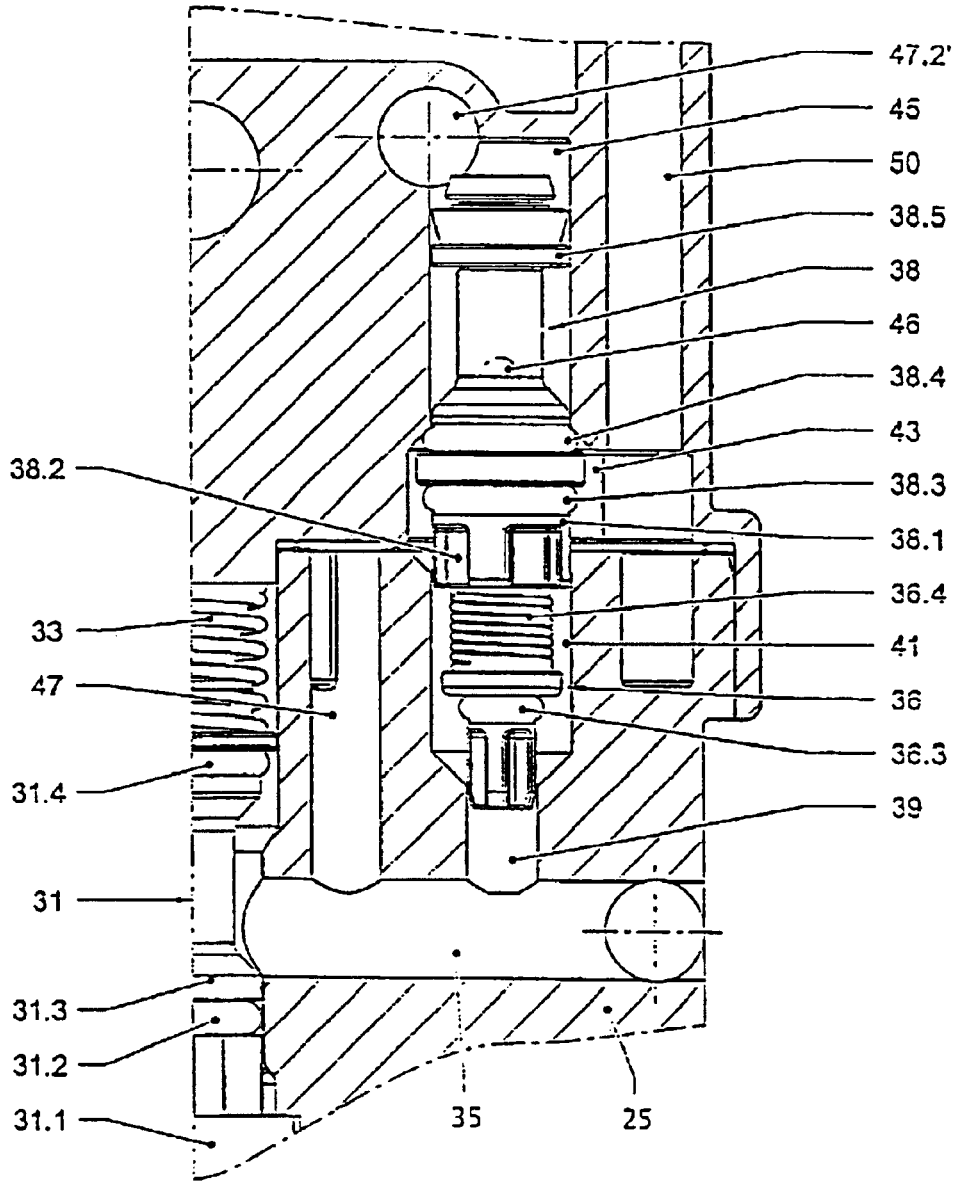
FIG. 8 shows an enlarged illustration of one of the two valve units of the actuating valve according to the invention.
Figure 9A:
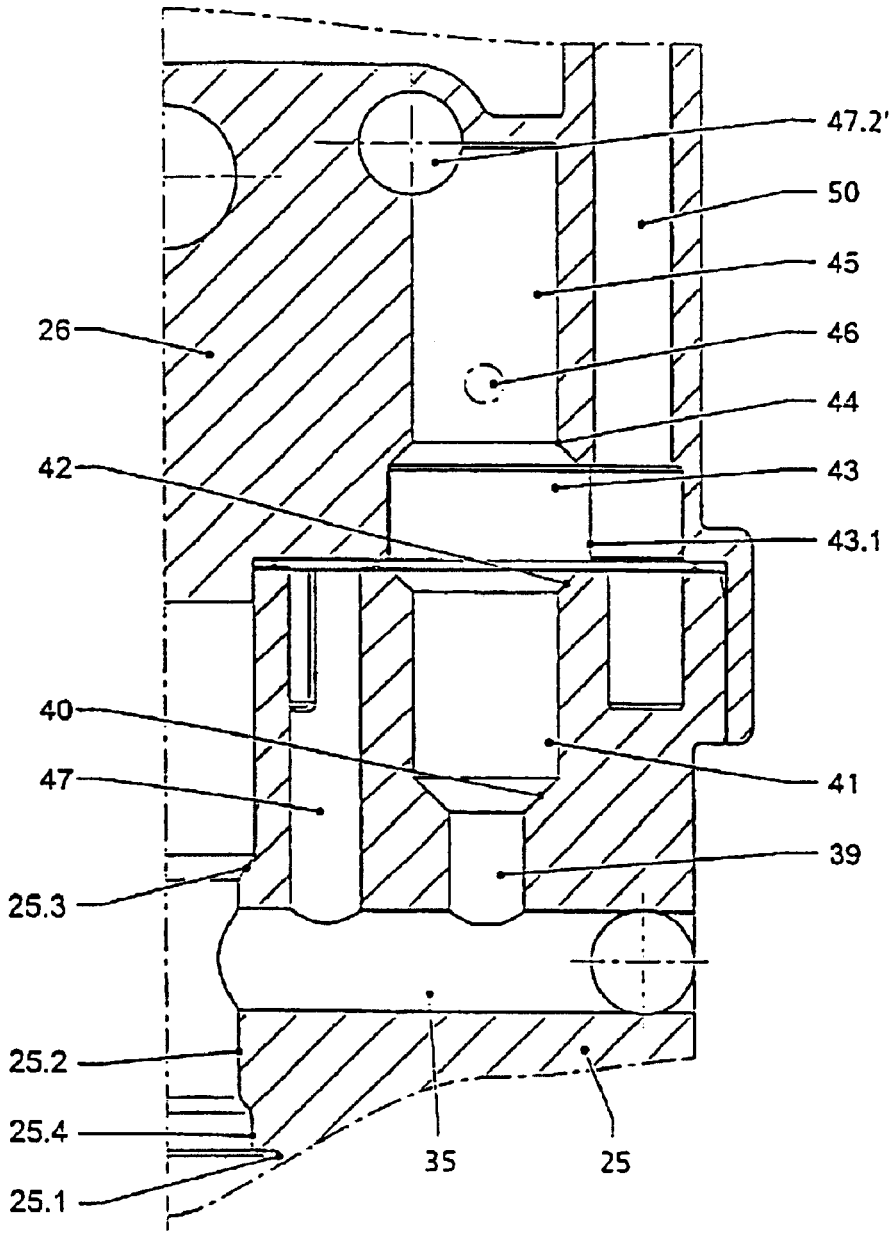
FIG. 9*a* shows an enlarged illustration of a part of the valve housing in section.
Figure 9B:
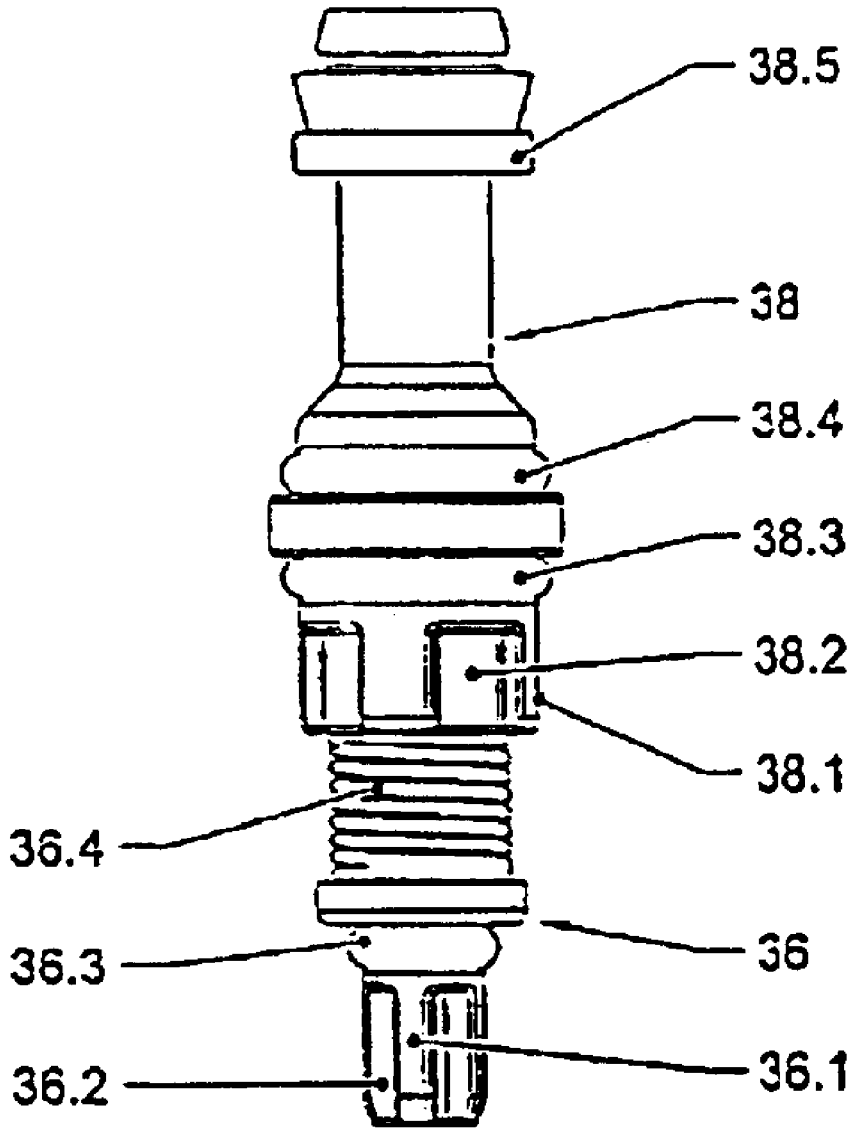
FIG. 9*b* shows two of the valve bodies outside of the valve housing.

A stepped bore adjoins the channel 35 according to FIGS. 7 and 9*a* and receives a twin valve unit comprised of a first lower valve body 36 and a second upper valve body 38. This stepped bore has a guide section 39 adjoining the channel 35, wherein a valve chamber 41 adjoins the guide section while forming a valve seat 40. By means of an additional valve seat 42 a valve chamber 43 adjoins the valve chamber 41, wherein the valve chamber 43 is connected by means of a valve seat 44 to the valve chamber 45 into which a venting channel 46 opens laterally.

The valve body 36 a valve shaft 36.1 guided in the guide bore 39 which has about its circumference several axial slots 36.2. On the topside of the valve shaft 36.1 a sealing ring 36.3 is provided which in the rest position is forced by the restoring spring 36.4, supported between the lower and upper valve bodies 36, 38, against the valve seat 40.

The valve body 38 has a valve shaft 38.1 guided in the valve chamber 41 which is essentially configured as a hollow cylinder with lateral wall openings 38.2 and whose interior is in communication with the valve chamber 41. This valve body 38 supports a first lower sealing ring 38.3 for cooperation with the valve seat 42 as well as a second upper sealing ring 38.4 for cooperation with the valve seat 44. The valve body 38 is also provided with a piston 38.5 which is sealingly guided in the valve chamber 45.

The actuating valve contains, in addition to the valve unit explained in connection with the valve bodies 31, 36, and 38, a second valve unit which is configured symmetrically thereto whose details are illustrated to the left in FIG. 6 and have the same reference numerals as the valve unit illustrated to the right in FIG. 6, wherein the reference numerals for the left valve unit are marked with an apostrophe.

The two valve units are connected to one another in accordance with the control lines L7, R7 of FIGS. 4*a* and 4*b* by control channels 47 and 47' connected to the channels 35, 35'. In accordance with FIGS. 6 and 7, the control channel 47 branching off the channel 35 has a connecting channel 47.1 extending transversely through the valve module top part 26 which opens with its mouth 47.2 into the valve chamber 45' above the valve member 38'.

By pressing down the key button R9, the valve unit to the right in FIG. 6 is actuated. In this way, the sealing ring 31.4 of the valve body 31 is lifted off the valve seats 25.3 facing the distribution chamber 28 so that compressed air can flow into the channel 35 and the guide bore 39. In this way, the lower valve body 36 is moved upwardly against the force of the restoring spring 36.4, and the sealing ring 36.3 is lifted off the valve seat 40 so that the compressed air flows through the radial slots 36.2 into the valve chamber 41 and thus also through the wall openings 38.2 of the valve shaft 38.1 into the valve chamber 43. This valve chamber 43 is connected by means of a lateral opening 43.1 to a connecting channel 50 to which is connected the compressed air connecting line R6 extending to the pressure chamber 8.4 so that the compressed air can flow into this compressed air pressure chamber 8.4.

In order to be able to move the piston 8.2 of the pneumatic cylinder unit 8, it is required to vent the other pressure chamber 8.3. This is realized in such a way that compressed air can flow into the valve chamber 45' above the valve body 38' via the control channel 47, the connecting channel 47.1 adjoining it, and the mouth 47.2 so that the valve body 38' is pressed downwardly causing the sealing ring 38.4' to be pushed away from its valve seat 44'. In this way, via the connecting lines L6 and 50' a connection between the pressure chamber 8.3 and the section of the valve chamber 45' positioned underneath the sealing piston 38.5' is produced so that the pressure chamber 8.3 is vented by the venting channel 46' connected to the valve chamber 45'.

In order to prevent a sudden pressure loss in the pressure chamber 8.3, a venting throttle (not illustrated) corresponding to the throttle L10 of FIGS. 4*a* and 4*b* is provided in the venting channel 46'. The same holds true also for the venting channel 46.

After releasing the key button L9, the lower valve body 36 is pushed downwardly by the restoring spring 36.4 so that the sealing ring 36.3 is pressed against the valve seat 40.

Since after releasing the key button R9 the compressed air supply, supplied via the venting channel system 47, 47.1 and 47.2 to the valve chamber 45' above the valve body 38', is canceled, this valve body 38' is again moved upwardly by the restoring spring 36.4' so that the sealing ring 38.4' is pressed against the valve seat 44'.

In this way, the positional locking of the pneumatic cylinder 8, described above in connection with FIGS. 4*a* and 4*b*, is effected.

In order to be able to move, on the one hand, the valve body 36 of the valve unit illustrated to the right and thus the sealing ring 36.3 against the valve seat 30 and, on the other hand, to move the valve body 38' of the valve unit illustrated to the left in the upward direction and thus move the valve seal 38.4' into a contact position against the valve seat 44', it is necessary to relieve the compressed air cushion which is present within the channel system 35, 47, 47.1, and 47.2. For this purpose, the venting system between the channel 35 and the environment is provided which has been described above in connection with the key button L9 in the rest position.

While specific embodiments of the invention have been shown and described in detail to illustrate the inventive principles, it will be understood that the invention may be embodied otherwise without departing from such principles.

What is claimed is:

1. A bobbin creel arrangement comprising:

a bobbin creel (2)

a four-bar linkage (4, 5, 6, 7) comprising a stationary member (4), adapted to be mounted on a machine frame of a textile machine, and moveable four-bar linkage members (5, 6, 7);

wherein the bobbin creel (2) is connected to the four-bar linkage so as to be pivotable relative to the machine frame from a lower loading position into an upper operating position;

at least one pneumatic cylinder (8) having a first end connected to the stationary member (4) and a second end connected to a first one (7) of the movable four-bar linkage members (5, 6, 7);

wherein, for pivoting the bobbin creel (2) from the operating position into the loading position, the pneumatic cylinder (8) is a bidirectional pneumatic cylinder loadable at the first and second ends by compressed air;

a pneumatic spring (9) having two ends and connected with the two ends to the four-bar linkage (4, 5, 6, 7), wherein the pneumatic spring (9) is tensioned when the bobbin creel (2) is pivoted into the loading position;

wherein the stationary member (4) has a first pivot axle (4.3) and wherein the first moveable four-bar linkage member (7) has a second pivot axle (7.2), wherein the first and second ends of the pneumatic cylinder (8) and the two ends of the pneumatic spring (9) are connected to the first and second pivot axles (4.3: 7.2), respectively, wherein the pneumatic spring (9) extends substantially parallel to the pneumatic cylinder (8).

2. The bobbin creel arrangement according to claim 1, wherein the pneumatic spring (9) is arranged between two of the pneumatic cylinders (8).

3. The bobbin creel arrangement according to claim 1, further comprising receiving members (12) mounted on the first moveable four-bar linkage member (7) positioned opposite the stationary member (4) and adapted to receive feed bobbins (Sp).

4. The bobbin creel arrangement according to claim 3, further comprising a frame (11) fastened on the first moveable four-bar linkage member (7), wherein the receiving members (12) for receiving feed bobbins (Sp) are provided on opposed sides of the frame (11).

5. The bobbin creel arrangement according to claim 1, wherein two of the pneumatic cylinders (8) are provided and attached with the second end, respectively, to the first four-bar linkage member (7) arranged opposite the stationary member (4).

6. The bobbin creel arrangement according to claim 5, wherein the stationary member (4) comprises two spaced apart frame parts (4.1) and two axles (4.2; 4.3) connecting the two frame parts (4.1), wherein the two axles form Joints of the four-bar linkage.

7. The bobbin creel arrangement according to claim 1, wherein at least one of the moveable four-bar members (6) is box-shaped.

8. The bobbin creel arrangement according to claim 1, comprising a frame (11) fastened on the first moveable four-bar linkage member (7) and provided with receiving member (12) for receiving feed bobbins (Sp), wherein the first four-bar linkage member (7) has two spaced apart wall sections (7.1) and an end face (7.3) connecting the two spaced apart well sections (7.1), wherein the two spaced apart wall sections (7.1) and the end face (7.3) form a support for the frame (11).

9. An actuating valve for a bobbin creel arrangement according to claim 1, having a pneumatic cylinder (8) comprising a first pressure chamber and a second pressure chamber (8.3, 8.4) separated from one another by a piston connected on a piston rod (8.1), the actuating valve comprising:

two first 3/2 port directional control valves as relay valves (L1, R1) connected to a compressed air source (P);

a valve system connected between the relay valves (L1, R1) and the pneumatic cylinder (8) and comprising a venting throttle;

wherein the valve system, upon actuation of one of the two relay valves, loads the first pressure chamber with compressed air while the second pressure chamber is relieved of pressure via the venting throttle;

wherein the valve system comprises two second 3/2 port directional control valves (L5, R5) arranged immediately upstream of the pneumatic cylinder;

wherein the valve system further comprises a first branch line (L3) connecting a first one of the relay valve (L1) to a first one of the second 3/2 port directional control valves (L5) and a second branch line (R3) connecting a second one of relay valve (R1) to a second one of the second 3/2 port directional control valves (R5);

wherein the branch lines (L3, R3) comprise a check valve (L4, R4), respectively;

wherein the valve system further comprises a first control line (L7) connecting the first brunch line (L3) to the second one of the second 3/2 port directional control valve (R5) and a second control line (R7) connecting the second branch line (R3) to the first one of the second 3/2 port directional control valves (L5);

wherein the first and second control lines control the first and second ones of the second 3/2 port directional control valves (L5, R5) between a first position allowing compressed air to pass and a second position for pressure relief such that a) when the relay valves (L1, R1) are not actuated, the first and second ones of the second 3/2 port directional control valves (L5, R5) are in the first position and the relay valves vent the first and second branch lines (L3, R3); while b) when one of the two relay valves is actuated, respectively, the actuated one of the relay valves assumes a position allowing compressed air to pass to the branch line connected to the actuated one of the relay valves.

10. The actuating valve according to claim 9, wherein the relay valves (L1, R1), the check valves (L4, R4), and the second 3/2 port directional control valves (L5, R5) are seat valves, wherein the seat valves comprise a valve body provided with sealing rings and adapted to move against a spring force into a valve chamber provided with a matching valve seat for the sealing rings.

11. An actuating valve for a bobbin creel arrangement according to claim 1, having a bidirectional pneumatic cylinder (8) comprising a first pressure chamber and a second pressure chamber (8.3, 8.4) separated from one another by a piston connected on a piston rod (8.1), the actuating valve comprising: two compressed air connecting channels (50, 50') connected to the bidirectional pneumatic cylinder (8)

two externally actuatable relay valves for alternatingly connecting one of the two compressed air connecting channels to a compressed air source P, respectively, and for simultaneously venting of the other compressed air connecting channel via a venting throttle;

wherein the compressed air connecting channels (50, 50') each have a valve unit arranged upstream thereof and the valve unit is comprised of two valve bodies (36, 36'; 38, 38') provided with sealing rings and two valve chambers (41, 43, 45 or 41', 43', 45') embodied as stepped bores, respectively, wherein the valve bodies are coaxially arranged relative to one another in the valve chambers;

wherein the valve unit further comprises a restoring spring (34.4, 36.4') loading the two valve bodies (36, 36', 38, 38') into a closed position, respectively.

12. The actuating valve according to claim 11, comprising a common valve module (25, 26), wherein the relay valves and the valve units are seat valves arranged in the common valve module and connected to one another such that upon actuation of one of the two relay valves the first pressure chamber is loaded with compressed air, while the second pressure chamber is vented so that, upon release of the momentarily actuated relay valve, the first and second pressure chambers of the pneumatic cylinder are loaded with compressed air and a positional locking of the pneumatic cylinder is achieved.

13. The actuating valve according to claim 12, wherein the valve module (25, 26) comprises a distribution chamber (28) common to the two relay valves and connected to a compressed sir source, wherein upon actuation of a one of the two relay valves a connection is provided to the compressed air connecting channel (50; 50') correlated with the actuated relay valve.

14. The actuating valve according to claim 13, wherein the relay valves each comprise a valve chamber (25.2) and a relay valve body (31) received in the relay valve chamber, wherein the relay valve chamber opens into the distribution chamber (28) and forms a relay valve seat (25.3), wherein the relay valve body (31) of the relay valve is moveable moved into the distribution chamber (28) counter to a spring action of a restoring spring (33) and comprises a sealing ring (31.4) provided at an end moveable into the distribution chamber (28), wherein the sealing ring interacts with the relay valve seat (25.3), wherein the relay valve chamber (25.2) has a channel (35) connected laterally to the relay valve chamber (25.2) and extending to the compressed air connecting channel (50) to the relay valve chamber (25.2).

15. The actuating valve according to claim 14, wherein a bore section (25.4) is connected to the relay valve chamber at an end of the relay valve chamber (25.2) remote from the distribution chamber (28), wherein the bore section has a diameter greater than a diameter of the relay valve chamber (25.2), wherein the relay valve body (31) at an end facing the bore section (25.4) has a sealing ring (31.2), wherein, the sealing ring, when the relay valve body (31) moves into the distribution chamber (28), is guided sealingly in the relay valve chamber (25.2) and, when the relay valve is not actuated, is arranged in the bore section (25.4) such that a connection between the channel (35) and the surroundings is provided laterally past the sealing ring (31.2).

16. The actuating valve according to claim 15, wherein:

the valve module (25, 26) has a stepped bore for receiving a twin valve unit;

wherein the twin valve unit comprises a first valve body (36) and a second valve body (38);

wherein the stepped bore has a guide section (39) connected to the channel (35);

wherein the twin valve unit comprises a first valve chamber (41), connected to the guide section (39) and forming a first valve seat (40), and a second valve chamber (43) connected to the first valve chamber (41) by a second valve seat (42), wherein the second valve chamber has a greater diameter than the first valve chamber (41), wherein the second valve chamber has a lateral opening to the compressed air connecting channel (50);

wherein the twin valve unit further comprises a third valve chamber (45) connected to the second valve chamber by a third valve seat (44) and a venting channel (46) connected to the third valve chamber and open to the surroundings;

wherein the first valve body (36) has a valve shaft (36.1) guided in the guide section (39) and having at least one peripheral axial slot, wherein the valve shaft has an upper side provided with a sealing ring (36.3) interacting with the first valve seat (40) of the first valve chamber (41);

wherein the second valve body (38) has a valve shaft (38.1) guided in the first valve chamber (41) configured substantially as a hollow cylinder with lateral wall openings (38.2) in order to provide in an open position of the first valve body (36) a connection to the first valve chamber (41) and the third valve chamber (43);

wherein the second valve body (88) has a first sealing ring (38.3) interacting with the second valve seat (42) as well as a second sealing ring (38.4) interacting with the third valve seat (44);

a restoring spring (36.4) supported on the first valve body and the second valve body;

wherein the second valve body (36) is provided with a piston (38.5) sealingly guided in the third valve chamber (45) such that, when compressed air loads the second valve body (38), the second valve body is moved against a spring force of the restoring spring (36.4) such that the sealing ring (38.4) is lifted off the third valve seat (44) and a connection between the venting channel (46) and the second valve chamber (43) and the compressed air connecting channel (50) is realized.

17. The actuating valve according to claim 16, wherein the venting channel (46) has a venting throttle.

18. The actuating valve according to claim 16, further comprising a channel system (47, 47.1) connected to the channel (35), wherein the channel system opens into the cylinder chamber (45') of the twin valve unit upstream of the compressed air connecting channel (50'), wherein the second valve body (38') of the second twin valve unit is moveable against the force of the restoring spring (36.4') correlated with this second twin valve unit such that a connection between the second compressed air connecting line (50') and the venting channel (46') of this second twin valve unit is realized.

* * * * *